US005738089A

United States Patent [19]

Hoshi et al.

[11] Patent Number: 5,738,089

[45] Date of Patent: Apr. 14, 1998

[54] EQUIPMENT FOR ASSISTING RESPIRATION AND SYSTEM FOR ASSISTING RESPIRATION

[75] Inventors: Hiroki Hoshi, Saiwai-machi; Hajime Kurosawa; Kimito Maeda, both of Sendai; Hitomi Iwasa, Osaka; Go Yurimoto, Osaka; Satoko Nanzyo, Osaka; Katsumi Ito, Osaka, all of Japan

[73] Assignee: Hiroki Hoshi, Sendai, Japan

[21] Appl. No.: 739,433

[22] Filed: Oct. 29, 1996

[30] Foreign Application Priority Data

Nov. 6, 1995 [JP] Japan ..... 7-311537

[51] Int. Cl.[6] ..... A61H 31/00

[52] U.S. Cl. ..... 128/204.18; 128/200.24; 128/205.16; 601/41

[58] Field of Search ..... 128/204.18, 200.11, 128/200.14, 200.242, 203.28, 205.16; 434/265; 482/128; 601/41

[56] References Cited

U.S. PATENT DOCUMENTS

| | | | |
|---|---|---|---|
| 2,233,506 | 3/1941 | Azaretti | 601/41 |
| 3,454,000 | 7/1969 | Bird et al. | 601/41 |
| 4,960,118 | 10/1990 | Pennock | 128/200.24 |
| 5,137,017 | 8/1992 | Salter | 128/204.18 |
| 5,239,995 | 8/1993 | Estes et al. | 128/204.18 |

FOREIGN PATENT DOCUMENTS

| | | | |
|---|---|---|---|
| 1225889 | 7/1987 | Canada | 601/41 |
| 9111166 | 8/1991 | WIPO | 601/41 |

*Primary Examiner*—Vincent Millin
*Assistant Examiner*—V. Srivastava
*Attorney, Agent, or Firm*—Frishauf, Holtz, Goodman, Langer & Chick

[57] ABSTRACT

A system for assisting respiration which includes a flat, belt-shaped, tube made of rubber, and having a valve for introducing air. The flat tube has an outer side comprising a layer of a rubber sheet having a high modulus of elasticity and an inner side comprising a layer of a rubber sheet having a low modulus of elasticity, and is attachable to a part of a lower breast to an upper abdomen portion of a patient for intermittently pressing the part of the lower breast to the upper abdomen portion of the patient responsive to air being introduced into the flat tube. A belt, having a same width as that of the flat tube and a length longer than that of the flat tube, is laminated to the flat tube at the outside of the flat tube, and may have sheet fasteners at both ends thereof. A flow sensor detects inspiration and expiration of a patient, a compressor supplies compressed air to the flat tube during a period of inspiration of the patient, a pressure regulator regulates a pressure of the compressed air supplied to the flat tube, a valve is provided for increasing the pressure of the compressed air supplied to the flat tube, and a release valve is provided for releasing pressure in the flat tube at an early time in a period of expiration of the patient. A switchover valve may be provided for causing the compressor to supply compressed air to the flat tube during the period of expiration and for causing the release valve to release pressure in the flat tube at the start of inspiration.

3 Claims, 5 Drawing Sheets

EQUIPMENT FOR ASSISTING RESPIRATION AND SYSTEM FOR ASSISTING RESPIRATION

FIELD OF THE INVENTION

The present invention relates to equipment for assisting respiration and a system for assisting respiration. More particularly, the present invention relates to an equipment for assisting respiration and a system for assisting respiration which is used for a patient having a lung disease, without causing feelings of discomfort and disorder, and at the same time improving dyspnea.

BACKGROUND OF THE INVENTION

Heretofore, artificial respiration by application of an air pressure in respiratory tracts has been conducted for patients having serious lung pneumatosis or bronchial asthma. However, in the above artificial respiration by application of an air pressure in respiratory tracts, the patient has a foreign body sensation and feeling of discomfort in the trachea and suffers a great deal of restriction on eating and conversation because a tube for the respiration must be kept in the trachea through the mouth, through the nose, or by tracheotomy. Therefore, a noninvasive method for controlling respiration which does not require insertion of a tube into the trachea has been desired, and a method of artificial respiration by high frequency vibration from the outside of the thorax, a method of a continuous positive air pressure in respiratory tracts (CPAP), and a method of vibration of the chest wall have been developed.

In the method of artificial respiration by high frequency vibration from the outside of the thorax, a chamber is attached to a patient in such a manner that the chamber covers the whole breast and an upper abdominal part, and vibration in pressure is applied by positive pressure and negative pressure alternating at a high frequency of about 120 to 180 bpm. Although the method of artificial respiration by high frequency vibration from the outside of the thorax is noninvasive, movement of the patient is restricted because the method requires a large equipment, and only a limited effect is shown on chronic arctation of respiratory tracts. Dyspnea is even increased occasionally in cases accompanied with a disease in the respiratory tracts.

In the method of a continuous positive air pressure in respiratory tracts, a patient is provided with a mask, and respiration is assisted by sensing change in the pressure by respiration of the patient. Collapse of the lung which tends to take place in artificial respiration can be prevented because the pressure inside of the respiratory tracts is always kept higher than the atmospheric pressure. However, eating and conversation of a patient is restricted because the patient must always be wearing the mask.

In the method of vibration of the chest wall, vibration is applied to an upper breast part and a lower breast part in a synchronized manner with inspiration and expiration of a patient to stimulate intercostal muscles. The patient feels uncomfortable although dyspnea of a patient having occlusive lung disease is improved.

SUMMARY OF THE INVENTION

Accordingly, the present invention has an object of providing an equipment for assisting respiration and a system for assisting respiration which require little restriction on movement of a patient when the equipment or the system is attached, do not cause feelings of discomfort and disorder, reduce the burden on the patient even in cases such as arctation of the respiratory tracts and large residual volume, and improve dyspnea and respiratory insufficiency.

As the result of extensive studies conducted by the present inventors to achieve the above object, it was discovered that, when a flat tube having an outer side comprising a layer of a rubber sheet having a high modulus of elasticity and an inner side comprising a layer of a rubber sheet having a low modulus of elasticity was attached to a part of lower breast to upper abdomen of a patient and intermittently pressed on the part of lower breast to upper abdomen by introducing air into the flat tube, dyspnea was improved. Moreover, it was unexpectedly discovered that the effect was exhibited to a remarkable extent when the part of lower breast to upper abdomen was pressed by supplying compressed air into the flat tube during the period of inspiration and releasing the pressure at an early time in the period of expiration. The present invention was completed on the basis of the discovery.

Thus, the present invention provides:

(1) An equipment for assisting respiration which comprises a flat tube made of rubber, having a belt shape, equipped with a valve for introducing air, and having an outer side comprising a layer of a rubber sheet having a high modulus of elasticity and an inner side comprising a layer of a rubber sheet having a low modulus of elasticity, is attached to a part of lower breast to upper abdomen of a patient, and intermittently presses the part of lower breast to upper abdomen by introducing air into the flat tube;

(2) An equipment for assisting respiration described in (1) wherein the equipment additionally comprises a belt which has the same width as that of the flat tube and a length longer than that of the flat tube, is laminated to the flat tube at outside of the flat tube, and has sheet fasteners attached to both ends thereof;

(3) A system for assisting respiration which comprises a flow sensor, a compressor, a pressure regulator, a valve for adding pressure, a valve for releasing pressure, and the equipment for assisting respiration described in any of (1) and (2), detects gas inspired or expired by a patient by the flow sensor, supplies compressed air into the flat tube during the period of inspiration, and releases pressure in the flat tube at an early time in the period of expiration; and (4) A system for assisting respiration which comprises a flow sensor, a compressor, a pressure regulator, a valve for adding pressure, a valve for releasing pressure, and the equipment for assisting respiration described in any of (1) and (2), detects gas inspired or expired by a patient by the flow sensor, supplies compressed air into the flat tube during the period of expiration, and releases pressure in the flat tube at the start of inspiration.

Figure 1A:
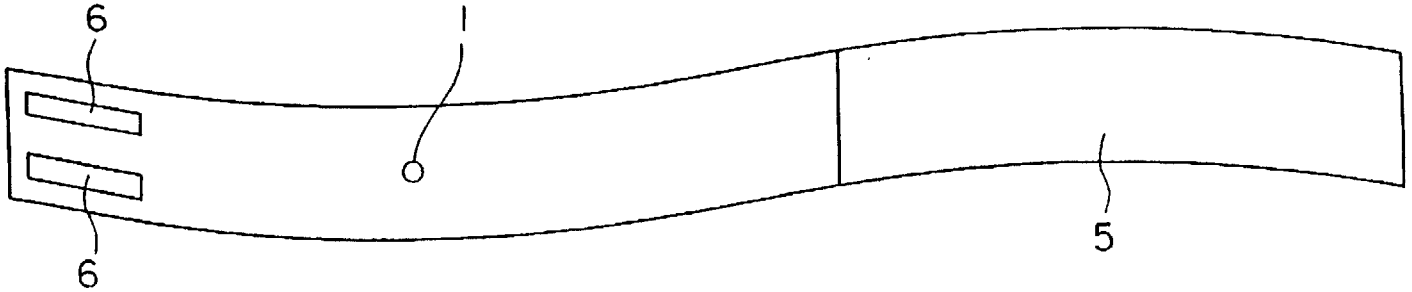
FIGS. 1(*a*) and 1(*b*) respectively show a plan view and a side sectional view of an embodiment of the equipment for assisting respiration the present invention.

The numbers shown in the figures have the meanings as listed in the following:

1: a valve

2: a flat tube made of rubber

3: an outer side of the flat tube

4: an inner side of the flat tube

5: a belt

6: a sheet fastener

7: a patient

8: an equipment for assisting respiration

DETAILED DESCRIPTION OF THE INVENTION

Figure 1B:
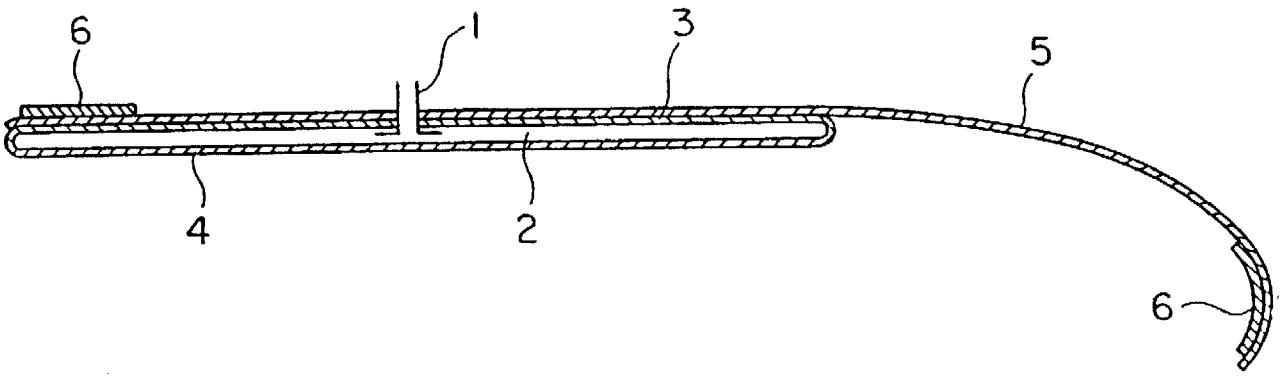

The present invention is described in detail in the following. FIG. 1(*a*) shows a plan view of an embodiment of the equipment for assisting respiration of the present invention, and FIG. 1(*b*) shows a side sectional view thereof. The equipment for assisting respiration of the present invention comprises a flat tube 2 made of rubber, having a belt shape, and equipped with a valve for introducing the air 1. The outer side 3 of the flat tube comprises a layer of a rubber sheet having a high modulus of elasticity and the inner side 4 of the flat tube comprises a layer of a rubber sheet having a low modulus of elasticity. When the equipment for assisting respiration of the present invention is attached to a part of lower breast to upper abdomen of a patient and the air is introduced into the flat tube from the valve for introducing the air, the layer of a rubber sheet having a high modulus of elasticity at the outer side of the flat tube is not deformed, and the layer of a rubber sheet having a low modulus of elasticity at the inner side of the flat tube is expanded to press the part of lower breast to upper abdomen of the patient. As for the size of the flat tube made of rubber which constitutes the equipment for assisting respiration of the present invention, in general, a width of 10 to 15 cm and a length of 60 to 100 cm are preferred for adults. An equipment having a smaller size may be used for infants and children. An equipment having a larger size may be used for patients of having a larger body.

It is preferred that the equipment for assisting respiration of the present invention additionally comprises a belt 5 which has the same width as that of the flat tube and a length longer than that of the flat tube, is laminated to the flat tube at the outside of the flat tube, and has sheet fasteners 6 attached to both ends thereof. When the belt is laminated to the flat tube and the sheet fasteners are attached to both ends of the belt, attaching and fixing the equipment for assisting respiration of the present invention to the part of lower breast to upper abdomen of a patient can be facilitated.

The rubber material used for preparation of the equipment for assisting respiration of the present invention is not particularly limited. For example, a rubber material having physical properties of a tensile stress of 9 to 12 MPa at an elongation of 300%, a tensile strength of 20 to 27 MPa, an elongation at break of 470 to 600%, and a Shore hardness of 57 to 60 after the rubber material is vulcanized can be used.

The process for preparing the equipment for assisting respiration is not particularly limited, and a conventional process for processing rubber materials can be used. For example, a sheet of unvulcanized rubber is cut to a rectangular shape, and the cut sheet is formed into a tube by adhering two longer edges together with a rubber adhesive. After a valve is attached to the obtained tube at a suitable position, both ends of the tube are adhered together with a rubber adhesive to prepare a flat tube. To a face of the prepared flat tube which is designated to be the outer side, a cord sheet in which fibers are arranged in the longitudinal direction with loose restrictions to the perpendicular direction is laminated to increase the modulus of elasticity of this side of the flat tube. A belt longer than the flat belt is laminated to the flat tube where necessary. By vulcanizing the whole combination, the equipment for assisting respiration of the present invention can be obtained.

Figure 2:
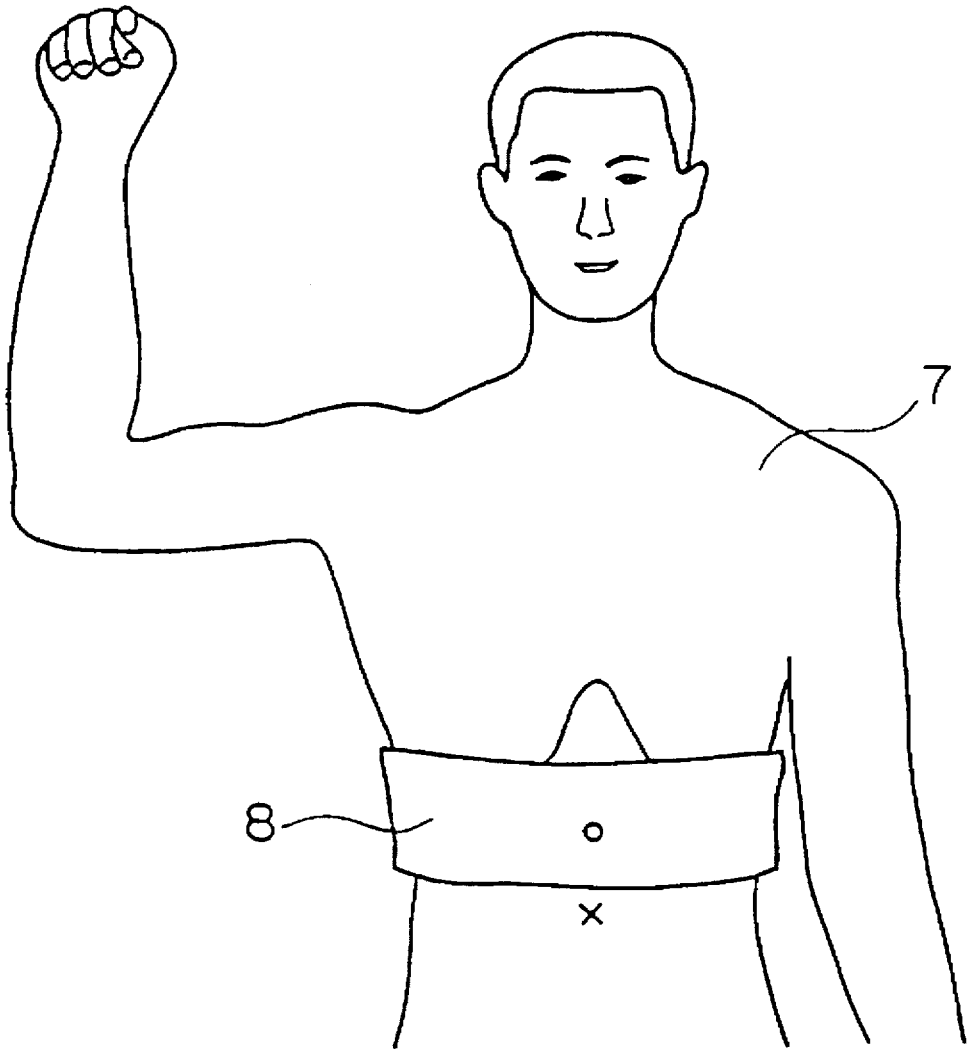
FIG. 2 shows a view of the system for assisting respiration of the present invention attached to a patient.

The equipment for assisting respiration of the present invention is attached to a part of lower breast to upper abdomen of a patient having occlusive lung disease. FIG. 2 shows a view of the system for assisting respiration of the present invention attached to a patient. In this figure, a patient 7 has the equipment for assisting respiration 8 of the present invention attached to a part of lower breast to upper abdomen. As the method for using the equipment for assisting respiration of the present invention, a method in which a specific pressure is constantly applied to the flat tube of the equipment for assisting respiration attached to the part of lower breast to upper abdomen, or a method in which the respiration of the patient is sensed and the pressure applied to the flat tube of the equipment for assisting respiration is varied in a synchronized manner with the respiration, may be adopted. When a specific pressure is constantly applied to the flat tube of the equipment for assisting respiration, it is suitable that the pressure is adjusted to 5 to 20 cm of water. When a patient having occlusive lung disease, such as lung pneumatosis or bronchial asthma, is attached to the equipment for assisting respiration of the present invention and a specific pressure is constantly applied to the flat tube, the respiration of the patient using the abdominal muscles is made easier, and dyspnea of the patient can be improved. Moreover, because training of the respiratory muscles can be practiced by using the equipment for assisting respiration of the present invention, the equipment can also be used as a tool for the respiratory training, and the conventional respiratory training using a sand bag becomes unnecessary. In the equipment for assisting respiration of the present invention, because the pressure in the flat tube can be kept constant simply by closing the valve after the pressure has been applied and no additional auxiliary equipment is required, it is made possible that the patient freely moves around while the patient is attached to the equipment for assisting respiration of the present invention.

In the equipment for assisting respiration of the present invention, the pressure applied to the flat tube can be varied in a synchronized manner with the respiration of the patient. When a conventional equipment for assisting respiration to which the pressure is applied in a synchronized manner with the respiration is used, it is generally practiced that the pressure is applied during the period of expiration of the patient, and the pressure is released or reduced during the period of inspiration. In contrast, when the equipment for assisting respiration of the present invention is used, it has unexpectedly been discovered in many cases that the respiration of the patient is assisted and the dyspnea is improved when a pressure is applied to the flat tube by introducing the compressed air during the period of inspiration of the patient and the pressure is released at an early time during the period of expiration. The system for assisting respiration of the present invention comprises a flow sensor, a compressor, a pressure regulator, a valve for adding pressure, and a valve for releasing pressure in addition to the equipment for assisting respiration of the present invention. The expiration and the inspiration of the patient is detected and the variation in the pressure applied to the flat tube is synchronized with the respiration of the patient by the above system.

Figure 3:
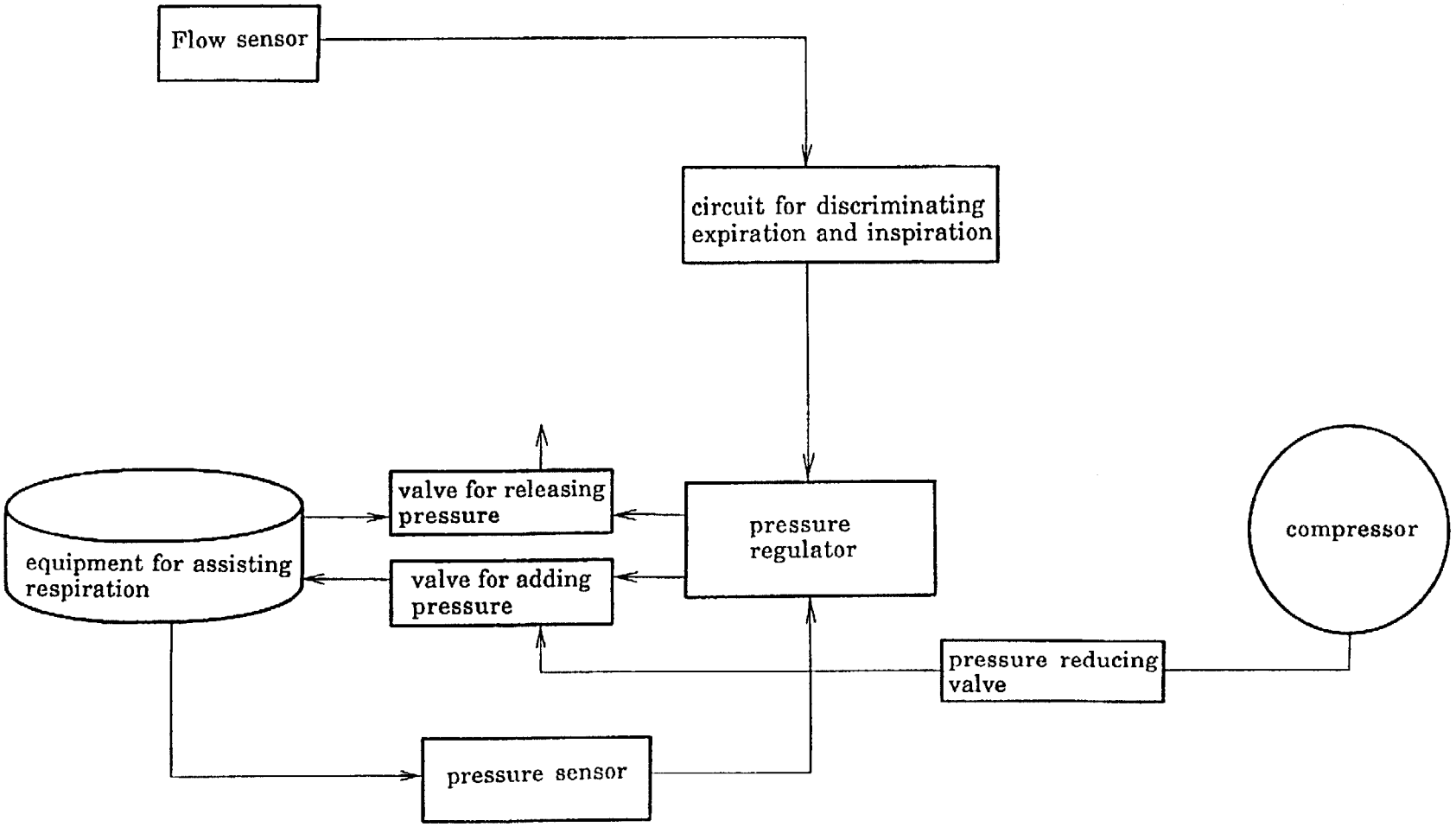
FIG. 3 shows a block diagram of the system for assisting respiration of the present invention.

FIG. 3 shows a block diagram of the system for assisting respiration of the present invention. In this system, the compressed air prepared by a compressor is introduced to the valve for adding pressure through a pressure reducing valve. A signal sent from a flow sensor placed in the nostril of a patient is detected by a circuit for discriminating expiration and inspiration, and a signal showing the inspiration or the expiration is sent to the pressure regulator. The equipment for assisting respiration is equipped with a pressure sensor which detects the pressure applied to the flat tube of the equipment for assisting respiration, and signals are sent to the pressure regulator so that the pressure applied to the flat tube is kept to a specified value. During the period of inspiration, the valve for releasing pressure is closed, and the valve for adding pressure is opened by the signal sent from the pressure regulator to supply the compressed air to the flat tube, and pressure is applied to the part of lower breast to upper abdomen of the patient. At an early time during the period of expiration, the valve for adding pressure is closed and the valve for releasing pressure is opened by the signal sent from the pressure regulator to release the pressure in the flat tube of the equipment for assisting respiration. In the system for assisting respiration of the present invention, the pressure applied to the patient can suitably be selected in accordance with the condition of the patient, and is generally selected in the range of 5 to 50 cm of water. The amount of the air sent to the equipment is not particularly limited and can suitably be selected in accordance with the volume of the flat tube of the equipment for assisting respiration in the expanded condition. In general, an amount of the air of about 500 ml per second is sufficient. By using the equipment for assisting respiration of the present invention, dyspnea of a patient having occlusive lung disease, such as lung pneumatosis and bronchial asthma, is improved, and wheeze of a patient having bronchial asthma is reduced. Collapse of bronchus and vesicula pulmonalis can be prevented by the outer movement at the early time during the period of expiration.

As described in the above, the system for assisting respiration of the present invention is effective in many cases when the pressure is added during the period of inspiration and the pressure is released at an early time during the period of expiration. However, it is occasionally effective to add the pressure during the period of expiration and release the pressure during the period of inspiration when a patient, for example, having a restrained lung disease is treated. For treatment of such a patient, the mode of control of the pressure regulator is changed. In more detail, the signal sent from the flow sensor placed in the nostril of a patient is detected by the circuit discriminating expiration and inspiration, and a signal showing the inspiration or the expiration is sent to the pressure regulator. The equipment for assisting respiration is equipped with a pressure sensor which detects the pressure applied to the flat tube of the equipment for assisting respiration, and a signal is sent to the pressure regulator so that the pressure applied to the flat tube is kept to a specified value. During the period of expiration, the valve for releasing pressure is closed and the valve for adding pressure is opened by the signal sent from the pressure regulator to supply the compressed air to the flat tube, and pressure is applied to the part of lower breast to upper abdomen of the patient. When the inspiration starts, the valve for adding pressure is closed and the valve for releasing pressure is opened by the signal sent from the pressure regulator to release the pressure in the flat tube of the equipment for assisting respiration. By using the equipment for assisting respiration of the present invention, dyspnea of a patient of restrained lung disease, such as fibroid lung and lung tuberculosis, is improved, and movement of the thorax at the early time during the period of expiration can be increased.

The equipment for assisting respiration and the system for assisting respiration of the present invention cause little discomfort and disorder when the equipment or the system are attached to a patient and can improve dyspnea by decreasing the index for dyspnea, i.e. by decreasing the so-called BORG index. In the cases of disease in respiratory tracts, a decrease in the pressure in respiratory tracts can be achieved. In the case of lung pneumatosis, an increase in one second dose can be achieved. The effect of removing phlegm is enhanced for a patient of bronchial asthma. Moreover, the equipment for assisting respiration and the system for assisting respiration of the present invention can be used as a training tool and a training system, respectively, for abdominal breathing.

To summarize the advantages obtained by the present invention, the equipment for assisting respiration of the present invention causes little discomfort and disorder to a patient having a lung disease and can improve dyspnea. The system for assisting respiration of the present invention can remarkably improve dyspnea by adding and releasing pressure in a synchronized manner with the respiration of the patient.

The present invention is described in more detail with reference to the following examples.

EXAMPLE 1

(Preparation of an Equipment for Assisting Respiration)

An equipment for assisting respiration having the structure shown in FIG. 1 was prepared. A rubber sheet having a thickness of 1.0 mm was prepared from an unvulcanized rubber which had a tensile stress of 10 MPa at an elongation of 300%, a tensile strength of 25 MPa, an elongation at break of 550%, and a Shore hardness of 58 after the rubber was vulcanized. The prepared rubber sheet was cut to a rectangular shape having a size of 240 mm×800 mm, wherein the edges having the length of 800 mm were cut to form inclined surfaces. One side of the sheet prepared by the cutting was completely covered with talc powder. The inclined surfaces formed by the cutting were coated with a rubber adhesive by using a brush. When the coated rubber adhesive was dump-dry, the inclined surfaces were brought together in such a manner that the side covered with talc powder was placed inside, and the inclined surfaces were pressed together by a roll to form a tube by adhesion. A hole was formed at the central part of the adhered part, and a valve was attached to the hole with a rubber adhesive. The inner surfaces of the open parts at both ends of the tube were coated with a rubber adhesive to a width of 12 mm. When the coated rubber adhesive was dump-dry, the tube was folded to bring the end parts together in such a manner that the valve was placed at the central position, and the end parts were pressed together by a roll to prepare a flat tube by tightly sealing both ends of the tube to each other. The outside of the flat tube, i.e. the side attached with the valve, is coated with a rubber adhesive. A rayon cord sheet in which fibers are arranged in the longitudinal direction with loose restrictions to the perpendicular direction was cut to 140 mm×830 mm and wetted with toluene in which a small amount of rubber was dissolved. The treated rayon cord sheet was attached to the outside of the flat tube, and the parts of the rayon cord sheet left protruded from the flat tube were folded inward and adhered to the flat tube.

A sheet of a thickness of 1.5 mm was prepared by using the same unvulcanized rubber as that used in the above and cut to a rectangular shape of 120 mm×1,350 mm to prepare a rubber sheet for a belt. A hole for the valve was formed on the rubber sheet for a belt at the position of the valve which is decided by placing an end of the rubber sheet for a belt at the position of an end of the flat tube. The part of the rubber sheet for a belt to be put together with the flat tube was coated with toluene in which a small amount of rubber was dissolved. The outside of the flat tube was also coated with toluene in which a small amount of rubber was dissolved. The rubber sheet for a belt and the outside of the flat tube were brought together and pressed to each other by a roll. The above-prepared flat tube attached with the rubber sheet for a belt was placed in an oven at 150° C. and vulcanized for 35 minutes. After the vulcanization, sheet fasteners were attached to both ends of the belt with a rubber adhesive to prepare an equipment for assisting respiration.

EXAMPLE 2

A patient having lung pneumatosis (male, 72 year old) was attached with the equipment for assisting respiration prepared in Example 1. A constant pressure of 10 cm of water was applied, and the condition of respiration was compared with the ordinary condition of respiration without the equipment for assisting respiration.

Figure 4A:
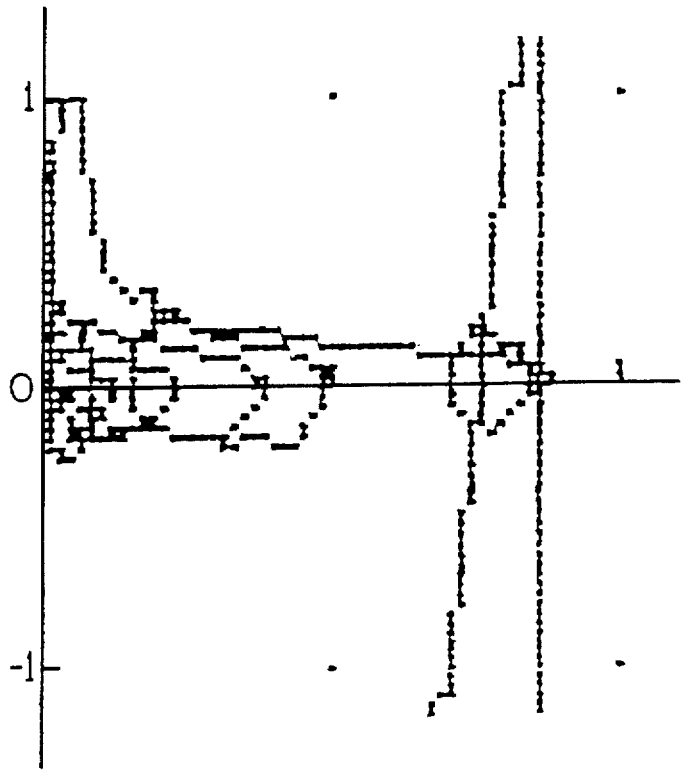
FIGS. 4(*a*) and 4(*b*) show graphs exhibiting the condition of respiration.
Figure 4B:
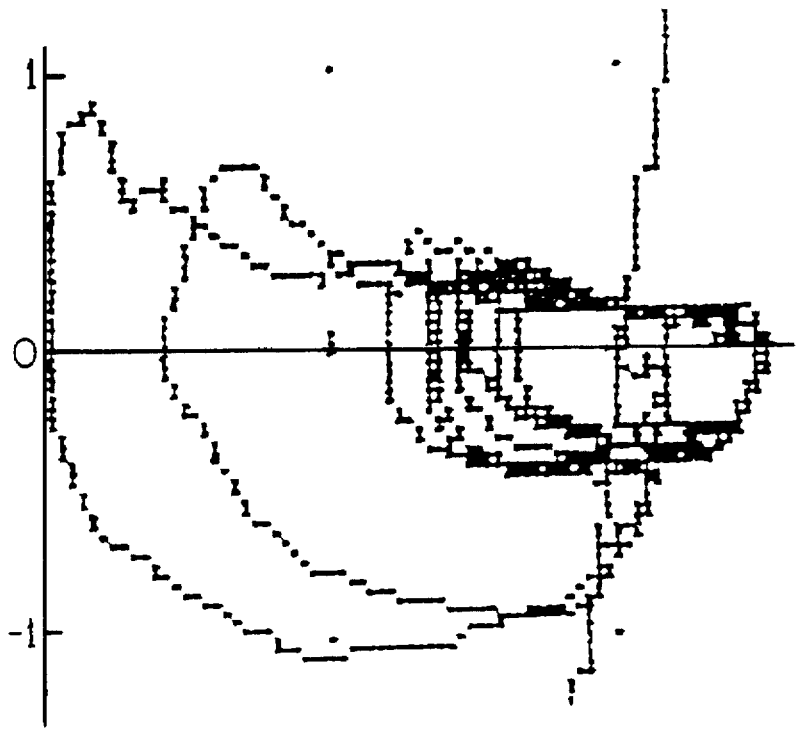

FIG. 4(*a*) shows a graph exhibiting the ordinary condition of respiration without the equipment for assisting respiration. FIG. 4(*b*) shows a graph exhibiting the condition of respiration when the equipment for assisting respiration was attached and the constant pressure of 10 cm of water was applied. In these graphs, the abscissa shows the time passed in one respiration, and the ordinate shows the amount of the respiration. It can be understood by comparing these graphs that the time passed in one respiration was longer and the amount of the respiration was larger under the condition in which the equipment for assisting respiration was attached and the constant pressure of 10 cm of water was applied than those under the condition without the equipment for assisting respiration, and thus the dyspnea was improved.

EXAMPLE 3

Tests for assisting respiration were conducted with 8 patients having lung pneumatosis and 8 patients having bronchial asthma by using the equipment for assisting respiration prepared in Example 1 in accordance with the system for assisting respiration shown in FIG. 3.

BORG index under the ordinary condition, BORG index under the condition in which the equipment for assisting respiration was attached and the pressure was added during the period of inspiration and released at an early time of the period of expiration, and BORG index under the condition in which the equipment for assisting respiration was used and the pressure was added during the period of expiration and released at the start of the inspiration were obtained with each patient. For deciding the pressure to be added, the pressure was changed by an increment of 5 cm of water, and the optimum pressure was obtained as the pressure showing the minimum value of BORG index. BORG index is an index indicating the degree of dyspnea in a number of 1 to 10. A larger number shows a higher degree of dyspnea. The results are shown in Table 1.

TABLE 1

| Patient No. | disease | BORG index: ordinary condition | BORG index: pressure added during inspiration | BORG index: pressure added during expiration | optimum pressure during inspiration (cm water) |
|---|---|---|---|---|---|
| 1 | lung pneumatosis | 3 | 1 | 5 | 15 |
| 2 | lung pneumatosis | 4 | 2 | 5 | 10 |
| 3 | lung pneumatosis | 3 | 2 | 3 | 10 |
| 4 | lung pneumatosis | 4 | 4 | 4 | — |
| 5 | lung pneumatosis | 3 | 3 | 2 | — |
| 6 | lung pneumatosis | 2 | 1 | 3 | — |
| 7 | lung pneumatosis | 3 | 0 | 5 | 35 |
| 8 | lung pneumatosis | 2 | 1 | 4 | 10 |
| 9 | bronchial asthma | 3 | 1 | 4 | 25 |
| 10 | bronchial asthma | 2 | 3 | 1 | — |
| 11 | bronchial asthma | 3 | 1 | 4 | 20 |
| 12 | bronchial asthma | 3 | 2 | 4 | 25 |
| 13 | bronchial asthma | 4 | 1 | 4 | 20 |
| 14 | bronchial asthma | 4 | 2 | 5 | 15 |
| 15 | bronchial asthma | 3 | 1 | 4 | 20 |
| 16 | bronchial asthma | 4 | 2 | 5 | 25 |

When the pressure was added during the period of inspiration, 13 patients showed decrease in BORG index, 2 patients showed no change in BORG index, and 1 patient showed increase in BORG index among 16 patients. When the pressure was added during the period of expiration, 2 patients showed decrease in BORG index, 3 patients showed no change in BORG index, and 11 patients showed increase in BORG index. It can be understood from these results that, when the equipment for assisting respiration and the system for assisting respiration of the present invention are used, dyspnea of a patient having an occlusive lung disease is remarkably improved by adding pressure during the period of inspiration and releasing the pressure at an early time in the period of expiration.

EXAMPLE 4

Test for assisting respiration was conducted with a patient having bronchial asthma (female, 24 years old) by using the equipment for assisting respiration prepared in Example 1 in accordance with the system for assisting respiration shown in FIG. 3, and respiration curves were obtained.

Figure 5A:
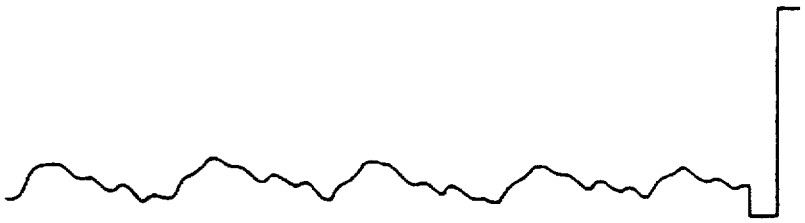
FIGS. 5(*a*)–5(*b*) show respiration curves.
Figure 5B:
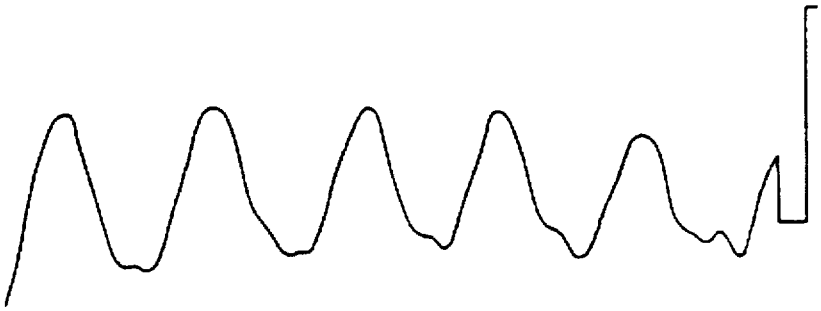
Figure 5C:
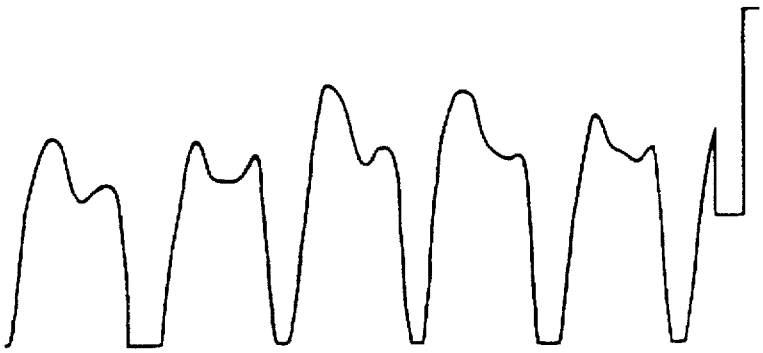

FIG. 5(*a*) shows a respiration curve under the ordinary condition in which the equipment for assisting respiration was not used. FIG. 5(*b*) shows a respiration curve under the condition in which the equipment for respiration was attached and a constant pressure of 20 cm of water was applied. FIG. 5(*c*) shows a respiration curve under the condition in which a pressure of 20 cm of water was applied during the period of inspiration and the pressure was released at an early time during the period of expiration. In the graphs showing the respiration curves, the abscissa shows time, and the ordinate shows the inspiration and the expiration wherein the upward direction shows the inspiration and the downward direction shows the expiration. It can be understood by comparing these respiration curves that the amount of the respiration was increased when the equipment for assisting respiration was attached and the constant pressure of 20 cm of water was applied in comparison with that under the ordinary condition without the equipment for assisting respiration, that the amount of the respiration was further increased and the respiration curve showed a double phase shape during the period of inspiration when the pressure of 20 cm of water was applied during the period of inspiration and the pressure was released at an early time during the period of expiration, and therefore, that dyspnea could remarkably be improved by using the equipment for assisting respiration and the system for assisting respiration of the present invention.

What is claimed is:

1. A system for assisting respiration, comprising:

a flat tube made of rubber, having a belt shape, and being equipped with a valve for introducing air, said flat tube having an outer side comprising a layer of a rubber sheet having a high modulus of elasticity and an inner side comprising a layer of a rubber sheet having a low modulus of elasticity, and said flat tube being attachable to a part of a lower breast to an upper abdomen portion of a patient for intermittently pressing the part of the lower breast to the upper abdomen portion of the patient responsive to air being introduced into the flat tube;

a belt which has a same width as that of the flat tube and a length longer than that of the flat tube, said belt being laminated to the flat tube at the outside of the flat tube;

a flow sensor for detecting inspiration and expiration of a patient;

a compressor for supplying compressed air to the flat tube during a period of inspiration of the patient;

a pressure regulator for regulating a pressure of the compressed air supplied to the flat tube;

a valve for increasing the pressure of the compressed air supplied to the flat tube; and a release valve for releasing pressure in the flat tube at an early time in a period of expiration of the patient.

2. The system for assisting respiration according to claim 1, further comprising a switchover valve for causing the compressor to supply compressed air to the flat tube during the period of expiration of the patient, and for causing the release valve to release pressure in the flat tube at the start of inspiration by the patient.

3. The system for assisting respiration according to claim 1, wherein said belt includes sheet fasteners attached to both ends thereof.

* * * * *